US006229531B1

(12) United States Patent
Nakajima et al.

(10) Patent No.: US 6,229,531 B1
(45) Date of Patent: May 8, 2001

(54) ACTIVE MATRIX DISPLAY DEVICE

(75) Inventors: Setsuo Nakajima, Kanagawa; Katunobu Awane, Nara; Tatsuo Morita, Kyoto, all of (JP)

(73) Assignee: Semiconductor Energy Laboratory, Co., LTD, Kanagawa-ken (JP)

( * ) Notice: Subject to any disclaimer, the term of this patent is extended or adjusted under 35 U.S.C. 154(b) by 0 days.

(21) Appl. No.: 08/919,253

(22) Filed: Aug. 27, 1997

(30) Foreign Application Priority Data

Sep. 3, 1996 (JP) ..... 8-252491

(51) Int. Cl.[7] ..... G09G 5/00

(52) U.S. Cl. ..... 345/205; 345/206; 345/92; 345/94; 345/98; 345/100

(58) Field of Search ..... 345/55, 63, 89, 345/100, 77, 99, 92, 94, 98, 205, 206; 359/55, 52

(56) References Cited

U.S. PATENT DOCUMENTS 5,013,939 * 5/1991 Satoh ..... 326/44
5,117,298 * 5/1992 Hirai ..... 359/55
5,151,805 * 9/1992 Takeda et al. ..... 359/57
5,196,738 * 3/1993 Takahara et al. ..... 307/296.1
5,526,012 * 6/1996 Shibahara ..... 345/92
5,583,532 * 12/1996 Watanabe ..... 345/89
5,646,643 * 7/1997 Hirai et al. ..... 345/100
5,657,037 * 8/1997 Okada et al. ..... 345/94
5,748,169 * 5/1998 Okumura et al. ..... 345/100
5,982,348 * 11/1999 Nakajima et al. ..... 345/92
5,986,631 * 11/1999 Nanno et al. ..... 345/94
5,995,074 * 11/1999 Kusafuka et al. ..... 345/90
6,028,578 * 2/2000 Ota et al. ..... 345/94
6,108,056 * 8/2000 Nakajima et al. ..... 349/38

* cited by examiner

*Primary Examiner*—Richard Hjerpe
*Assistant Examiner*—Henry N. Tran
(74) *Attorney, Agent, or Firm*—Fish & Richardson, PC

(57) ABSTRACT

An active matrix display device comprising an integrated peripheral driver circuit improved in image quality, provided in such a constitution that the feed through voltage ΔVs is set lower than the voltage Vgr necessary for realizing a single gradation. In this manner, a stable gradation display is obtained without being influenced by the feed through voltage ΔVs even when the fluctuation in the characteristics of the thin-film transistors provided in active matrix circuit may fluctuate the ΔVs.

29 Claims, 11 Drawing Sheets

ACTIVE MATRIX CIRCUIT 100

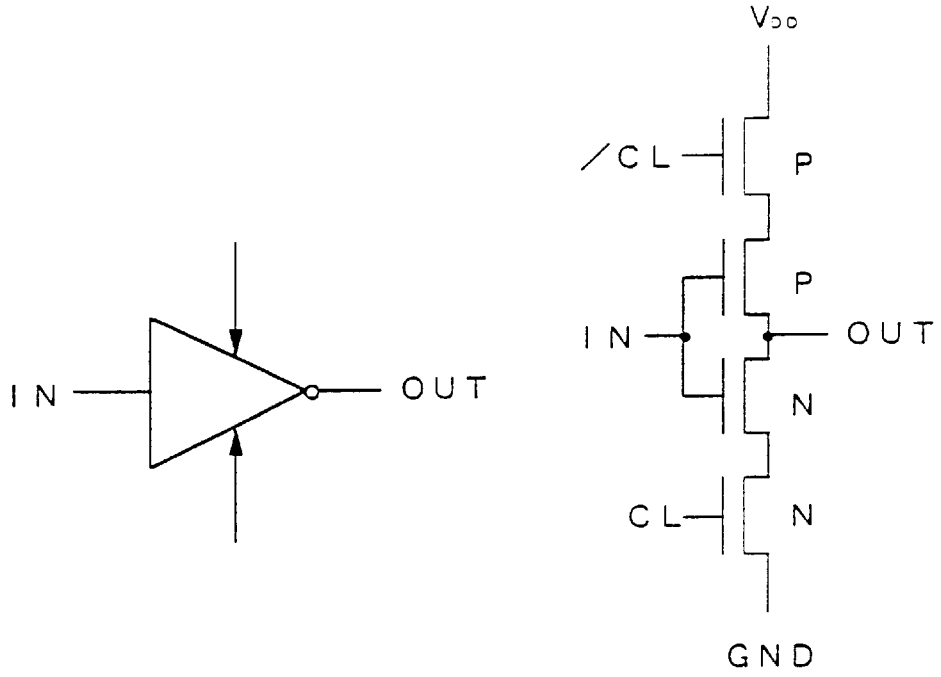
Fig. 2A CLOCKED INVERTER
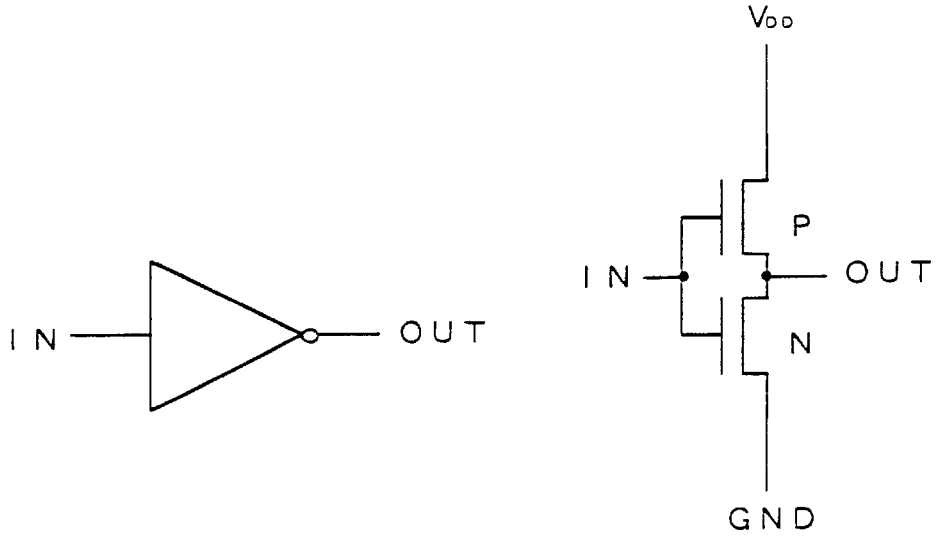
Fig. 2B INVERTER

ACTIVE MATRIX DISPLAY DEVICE

BACKGROUND OF THE INVENTION

The present invention relates to an active matrix-type flat panel display.

Conventionally, active matrix-type liquid crystal display devices using amorphous silicon film are known. Further, there are known active matrix-type liquid crystal display devices which employ a crystalline silicon film and are capable of providing a higher display quality.

When an amorphous silicon film is used, there is a problem that a P-channel type thin-film transistor cannot be realized (no practical use because of low characteristics). On the other hand, in the case where a crystalline silicon film is used, a P-channel type thin-film transistor can be manufactured.

Therefore, when a crystalline silicon film is used, a CMOS circuit can be constructed by using a thin-film transistor. By utilizing this fact, a peripheral driver circuit for driving an active matrix circuit may also be constructed of a thin-film transistor.

Consequently, as shown in FIG. 10, a constitution comprising an active matrix circuit 10 and peripheral driver circuits 11 and 12 integrated on a single glass substrate or quartz substrate can be realized. Such a constitution is called as an integrated peripheral driver circuit type.

The constitution of the integrated peripheral driver circuit type has a feature of capable of downsizing the overall display device and reducing its manufacturing cost and steps.

In the case where an image with high quality is pursued, how fine gradation display can be achieved is an important factor. In general, a non-saturated region in a voltage-transmittance curve of a liquid crystal is used in case of implementing a gradation display. In other words, the gradation display is realized by utilizing the range where the optical response changes with the change of applied voltage (electric field). Generally, this method is called as an analog gradation method.

When the above analog gradation method is employed, the followings are factors leading to impair of the image quality. The main factor among them is the case in which fluctuation in voltage applied to the liquid crystal of the respective pixels becomes greater than the voltage necessary for a single gradation. In such a case, it results in the state such that an image is swaying or stripes are appeared in the display device.

The fluctuation in the voltage applied to the liquid crystals of the respective pixels is attributed to the fluctuation in the characteristics of the thin-film transistors arranged in a matrix of several hundred by several hundred. Also, in case of an integrated peripheral driver circuit type, the fluctuation in the thin-film transistor provided in the driver circuit also contributes to the fluctuation in the above voltage.

In general, the fluctuation in the characteristics of a thin-film transistor depends on numerous parameters. Accordingly, even if one of such parameters is controlled, it is still difficult to overcome the above-mentioned problems of image degradation. The problem is more serious because there is also a parameter that cannot be controlled to completely restrain the fluctuation in the characteristics of a thin-film transistor.

The present invention disclosed in this specification has an object to provide a guideline as to which parameter of a thin-film transistor should be controlled preferentially in manufacturing an active matrix-type display device.

According to the knowledge of the present inventors, the fluctuation in the drive voltage for driving a liquid crystal, which is closely related to the degradation of the image quality of a liquid crystal display device, is mostly attributed to the feed through voltage in the respective pixels.

The influence of the feed through voltage on a liquid crystal display of an active matrix type is described in Technical Report of IEICE (The Institute of Electronics, Information and Communication Engineers), EID95-99, ED95-173, SDM95-213 (1996-02).

Brief explanation of the feed through voltage is given below. FIG. 11 shows the drive voltage for driving a thin-film transistor arranged in an active matrix circuit.

In FIG. 11, Vg represents a signal voltage supplied from a gate signal line to the gate electrode of a thin-film transistor. Vs represents another signal voltage supplied from a source wiring to the source region of the thin-film transistor. Further, Vd represents the waveform of the voltage applied to the liquid crystal from a pixel electrode. Incidentally, the gate signal lines and the drain lines are arranged in a matrix form.

The gate voltage Vg first rises to the ON level Vgh, then the thin-film transistor turns ON, so that the voltage signal supplied from the source signal line may be applied to the liquid crystal.

Even after the gate voltage Vg is lowered to the OFF level Vgl, the electric field is succeedingly applied to the liquid crystal by the charge stored in the liquid crystal and the auxiliary capacitance.

Thus, the image information is rewritten in the pixel electrode when a pulse of the next gate voltage Vg is inputted into the gate electrode. That is, the thin-film transistor is turned ON again when a pulse of the next gate voltage Vg is inputted into the gate electrode, and the charge corresponding to new Vs flows into the pixel electrode.

Generally, to prevent the degradation of liquid crystal, an AC voltage represented by Vsigc±Vsig is used for the voltage Vs. In this case, Vsigc represents the center voltage, and Vsig represents the image signal voltage. Also, the value of Vsig corresponds to the gradation.

When driving such a thin-film transistor, the fall voltage of the gate voltage Vg in switching the thin-film transistor from an ON state to an OFF state causes the fluctuation of drain voltage through the parasitic capacity between the gate and the drain. This fluctuation in voltage is the feed through voltage (ΔVs).

FIG. 11 shows the influence of the feed through voltage (ΔVs). The feed through voltage (ΔVs) can be expressed by the following expression (1):

$$\Delta Vs = 1/Ct[Cgd \cdot \Delta Vg - \int Idt] \quad (1)$$

where, Ct represents the total pixel capacity inclusive of that of the auxiliary capacitance; Cgd represents the parasitic capacitance between the gate and the drain; and ΔVg is the fluctuation amount in the gate voltage. In case of FIG. 11, ΔVg is expressed by ΔVg=Vgh−Vgl.

The term expressed by fldt shows the influence of a current flowing between the source and the drain ascribed to the deformation in the waveform of the signal voltage supplied by the gate signal line.

Referring to FIG. 10, the signal waveform propagated through the gate wiring results in a distorted waveform 13 due to the poor characteristics of the gate driver circuit. The distortion of the signal waveform 13 is also affected by the time constant which depends on the product of the resistance of the wiring and the capacitance of the wiring. However, in case that a material of low resistance, such as aluminum, is used for the wiring, the driving force of the driver circuit becomes dominant on the waveform.

When the thin-film transistor in the active matrix region is driven by such a distorted waveform 13 as shown in FIG. 10, a predetermined time period is necessary to completely turn OFF the thin-film transistor. During this predetermined period of time, furthermore, the current flows in a direction of correcting the feed through voltage.

The term expressed by ∫Idt in expression (1) gives the total quantity of this current.

SUMMARY OF THE INVENTION

An object of the present invention is to suppress the degradation in image quality of a display device attributed to the fluctuation in feed through voltage. To attain the above object, the present invention has a feature that the value of voltage Vgr necessary for realizing single gradation is set larger than the feed through voltage ΔVs expressed by the expression (1).

In other words, the present invention is characterized by setting the respective parameters to satisfy the relation expressed by expression (2) below:

$$|Vgr|>|1/Ct[Cgd\cdot\Delta Vg-\int Idt)]| \quad (2)$$

where, Vgr represents the voltage necessary for realizing single gradation, that is Vgr is a voltage corresponding to one single gradation level in the voltage applied to a pixel electrode; Ct represents the total pixel capacity inclusive of that of the auxiliary capacitance; Cgd represents the parasitic capacity between the gate and the drain; ΔVg is the difference between the ON and OFF state of the gate voltage; and ΔVs is the feed through voltage. It should be noted that the impurity region on the pixel electrode side is defined as drain.

Vgr and ΔVg depend on the drive conditions. Ct and Cgs are set at the design stage. Although ∫Idt per se is impossible to measure, it can be calculated by obtaining ΔVs through expression (1). ΔVs may be obtained by a direct measurement on a sample, or by performing simulation.

By setting the parameters to satisfy the relation given by expression (2), the gradation display can be set free from the influence of the fluctuation that occurs on the value of feed through voltage ΔVs due to the fluctuation in parameters.

To satisfy expression (2), it is effective to obtain high value for the total pixel capacity Ct. That is, it is effective to increase the auxiliary capacitance.

Further, expression (2) can be advantageously satisfied by increasing the value I included in the term ∫Idt. This value I can be elevated by increasing the mobility of the thin-film transistors provided in the active matrix region.

Further, another constitution of the present invention has a feature that to satisfy the expression (2), signal voltage intentionally delayed in fall of the signal waveform is supplied to the gate electrode of the respective thin-film transistors provided to the active matrix circuit (i.e., to the thin-film transistors provided in the respective pixel electrodes).

In other words, referring to FIG. 12 showing a display device comprising peripheral driver circuits 101 and 102 integrated with an active matrix circuit 100, the present invention is featured that a gate signal waveform 103 is supplied to the gate signal line from the peripheral driver circuit (gate driver circuit 101).

By controlling the delay in fall of the gate signal waveform utilizing such a waveform as shown by 103 of FIG. 12, the value of the term ∫Idt in expression (2) may be varied.

FIG. 12 shows a method of delaying the fall of a gate signal waveform 103, but not by using a rectangular wave pulse of a conventional type, but by employing a waveform in which the staged fall in signal occurs.

Further, the fall in gate signal waveform may be delayed by employing a waveform in which the signal is gradually lowered.

In this case, it is important that the delay of the fall in gate signal waveform is set such that the value of ∫Idt in expression (2) may fall as close as possible to the value of Cgd·ΔVg.

By supplying a signal waveform 103 as shown in FIG. 12 from the gate driver circuit 101, the expression (2) may be satisfied more easily, thereby being capable of suppressing the influence of the fluctuation in the characteristics of the thin-film transistors on the gradation display.

BRIEF DESCRIPTION OF THE DRAWINGS

FIGS. 2A and 2B show the constitution of each of the circuits;

DETAILED DESCRIPTION OF THE PREFERRED EMBODIMENT

Figure 1:
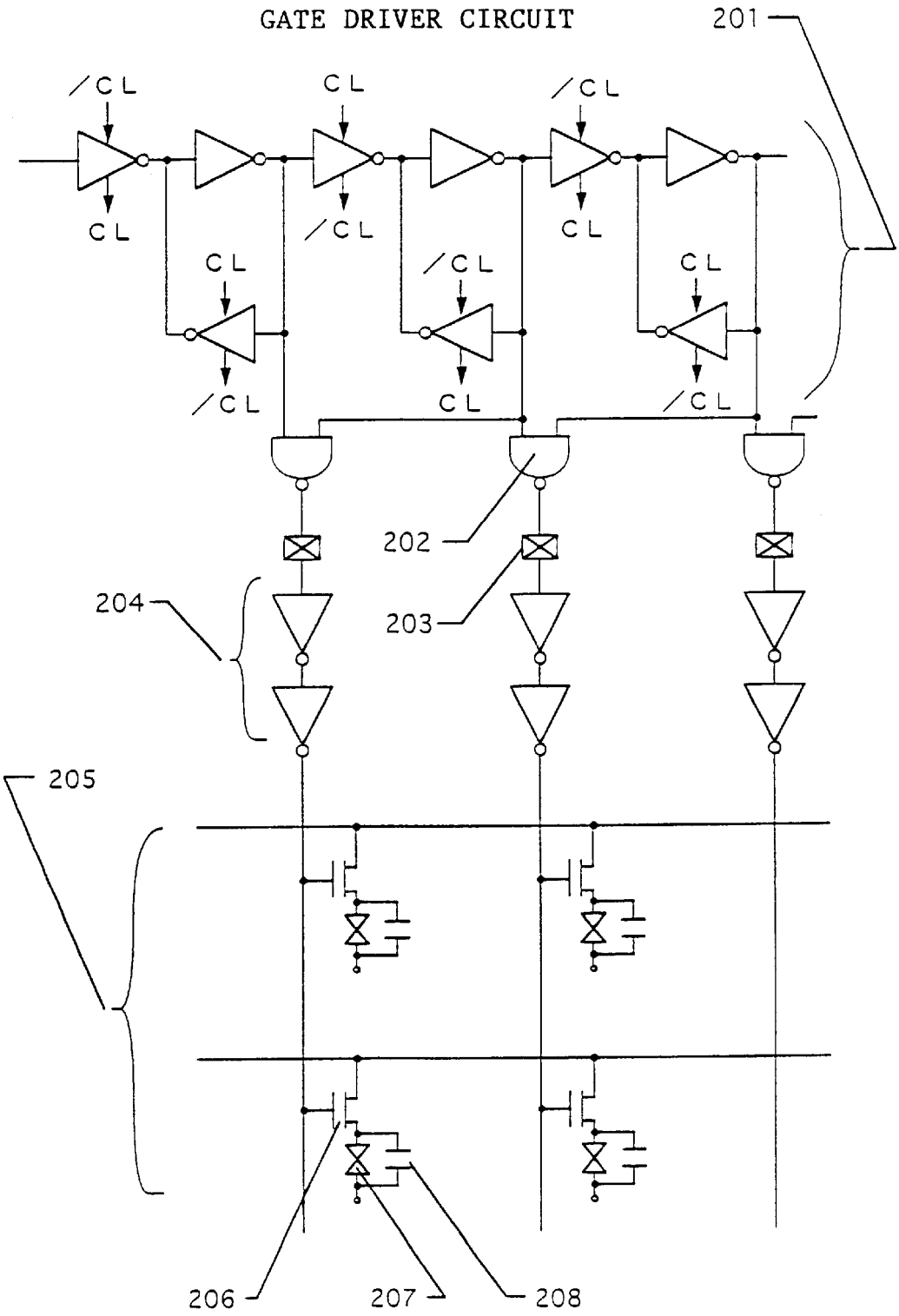
FIG. 1 shows a constitution in which an active matrix circuit is integrated with a peripheral driver circuit.

Referring to FIG. 1, a constitution according to the present invention comprises a peripheral driver circuit and an active matrix circuit integrated on a single glass substrate. FIG. 1 shows a constitution of one of the substrates of an active matrix liquid crystal display device of a peripheral driver circuit integrated type.

In FIG. 1, reference numeral 201 denotes a shift register circuit. Reference numeral 202 denotes a NAND circuit. Reference numeral 203 denotes a level shift circuit. Reference numeral 204 denotes a buffer circuit (driver circuit) for driving an active matrix circuit. In FIG. 1, the peripheral circuit is constructed by those circuits.

Also, in FIG. 1, reference numeral 205 denotes an active matrix circuit. In the figure, only four pixels are shown, however, in a practical circuit, several hundred by several hundred of pixels are arranged.

The respective pixels comprise a thin-film transistor indicated by reference numeral 206 and an auxiliary capacitance indicated by reference numeral 208. A liquid crystal is also shown in the constitution by reference numeral 207.

In the constitution shown in FIG. 1, all circuits are constructed by thin-film transistors formed on the same single glass substrate.

For instance, each of the gates constituting the shift register circuit 201 is constructed by a clocked inverter circuit consisting of a combination of P-channel and N-channel type thin-film transistors as shown in FIG. 2A.

Furthermore, each of the gates constituting the buffer circuit 204 is constructed by an inverter circuit consisting of a combination of P-channel and N-channel type thin-film transistors as shown in FIG. 2B.

To satisfy the relation given by expression (2), it is effective to elevate the mobility of the thin-film transistors and to maximize the capacity of the auxiliary capacitance 208 as much as possible.

Further, it is also effective to design the shape of the active layer constituting the thin-film transistor 206, such that the channel width and channel length are minimized as much as possible. This signifies decreasing the value of Cgd in expression (2).

The combination of the parameters, the size of the display device, cost, and the required display characteristics are taken into the consideration.

Figure 12:
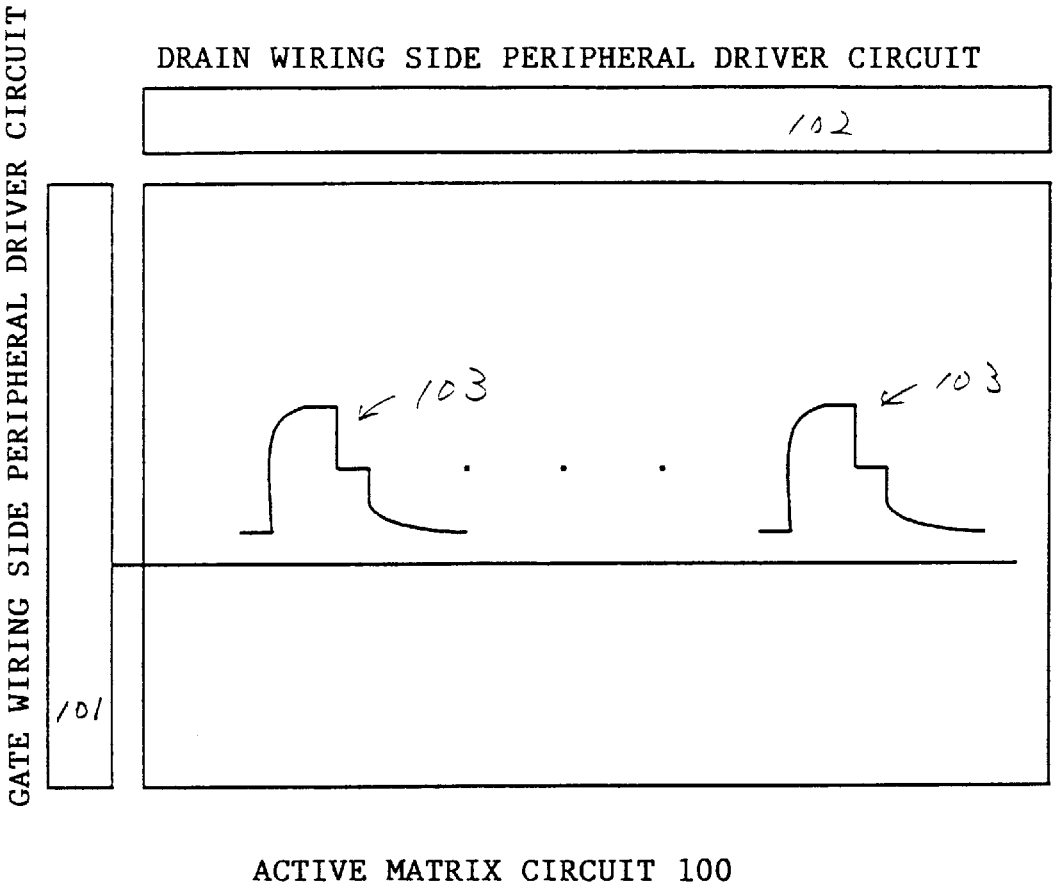
FIG. 12 shows a drive waveform in the active matrix circuit.

Further, the fall in signal waveform supplied to the gate signal line of the active matrix circuit 205 from the gate driver circuit shown in FIG. 1 is intentionally delayed as shown in FIG. 12.

Thus, the value of $\int Idt$ in expression (2) may be controlled. With this result, the required conditions expressed by expression (2) may be satisfied, and the fluctuation in characteristics of the respective thin-film transistors that affects the gradation display may be suppressed.

DESCRIPTION OF PREFERRED EMBODIMENTS

The present invention is described in further detail below with reference to the following examples.

EXAMPLE 1

Figure 3A:
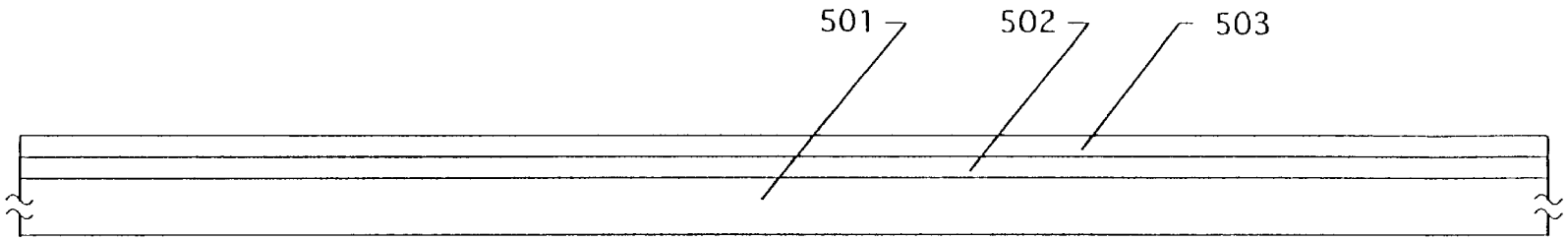
FIGS. 3A to 3C schematically show the process steps for manufacturing the active matrix circuit and the peripheral driver circuit simultaneously.
Figure 3B:
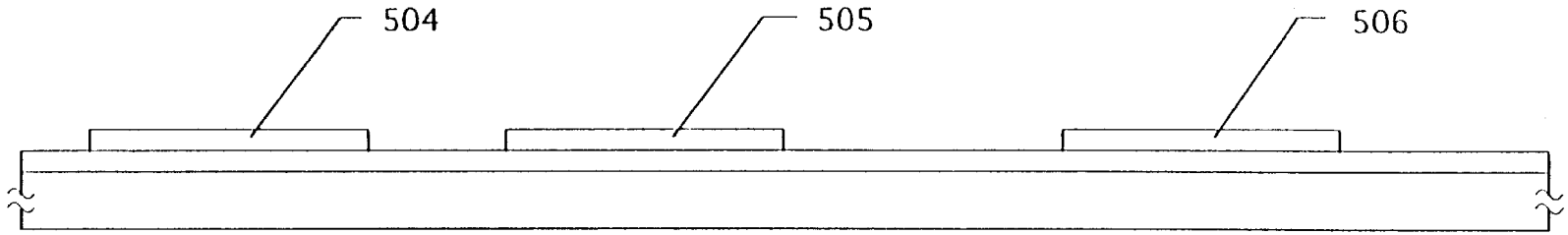
Figure 3C:
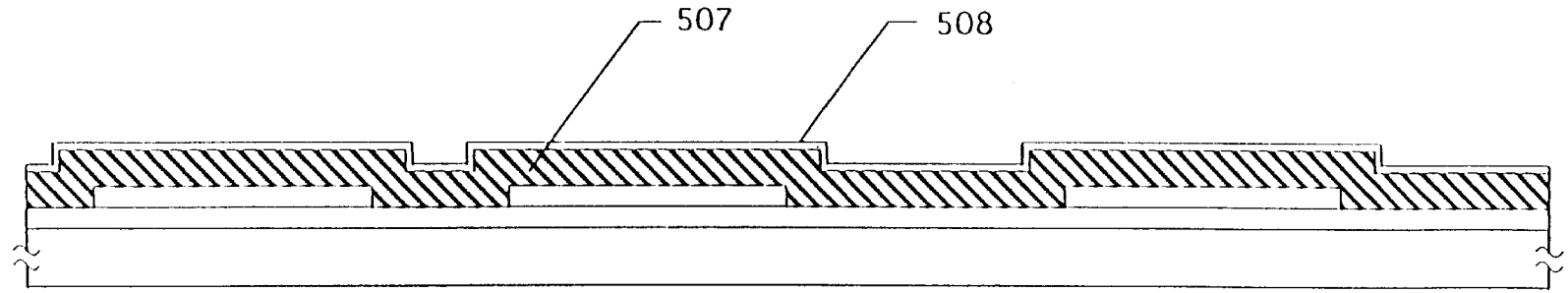

FIGS. 3A to 3C and the figures following thereto show the basic process steps for forming, on the same single glass substrate, a circuit comprising thin-film transistors in a CMOS constitution, which is the basic circuit for constructing a shift register circuit 201 or a buffer circuit 205 shown in FIG. 1, and a thin-film transistor 206 to be provided in each of the pixels of an active matrix circuit 205.

In the figures, the manufacturing steps for the CMOS circuit are shown in the left side, and the manufacturing steps for an N-channel -type thin-film transistor 205 to be provided in the active matrix circuit 206 are given on the right side.

The values and conditions that are described hereinafter are only provided for a representative example, and may be changed or optimized when necessary. That is, the values and conditions are not only limited to them.

First, a 3,000-Å-thick silicon oxide film which functions as a base film 502 is formed by means of sputtering on a glass substrate (or a quartz substrate) 501.

A 1,000-Å-thick amorphous silicon film 503 which is intrinsic or a conductivity that is substantially intrinsic is formed on the base film 502 by means of plasma CVD. Reduced pressure thermal CVD may be used as an alternative film deposition method. Thus is obtained a state shown in FIG. 3A.

The amorphous silicon film 503 is crystallized by applying heat treatment. The crystallization is effected by irradiating a laser light or by lamp annealing, or by a combination thereof with heat treatment.

The crystallinity achieved in this process step relates to the value of I in expression (2). Thus, it is important to adjust the conditions as to satisfy the relation expressed by expression (2).

In this step, the crystallinity of the silicon film necessary for the respective circuits can be selectively controlled by selectively performing the irradiation of the laser light or lamp annealing.

The term "crystalline silicon film" as referred in this specification signifies a silicon film that is modified by applying heat treatment of by irradiating a laser light into a film having a crystal structure with higher ordering. In general, amorphous silicon film is used as the starting film.

Thus, the term "crystalline silicon film" used in this specification refers to a silicon film having a crystal structure with higher ordering as compared with that of an amorphous silicon film.

Once the amorphous silicon film 503 is crystallized, patterning is performed to obtain island-like regions 504, 505, and 506 (FIG. 3B).

Referring to FIG. 3B, the region 504 later provides an active layer for a P-channel type thin-film transistor which constitutes the CMOS circuit, whereas the region 505 later provides an active layer for a N-channel type thin-film transistor of the CMOS circuit. The region 506 later provides an active layer of an N-channel type thin-film transistor that is provided in an active matrix circuit (pixel matrix circuit). Thus is obtained a state shown in FIG. 3B.

It should be noted that in the figure, the active layers 504, 505, and 506 are all shown at the same size. However, in practice, the channel width and channel length of each of the thin-film transistors are set in such a manner to satisfy the relation shown by expression (2), and the patterning of each of the active layers is performed accordingly.

More specifically, the active layer 506 of the thin-film transistor provided in the active matrix region is formed in such a manner that the channel length and the channel width is provided as narrow as possible (as a matter of course, the size of the gate electrode must be set in accordance therewith).

This aims to minimize the value of Cgd in expression (2).

On the other hand, the channel width of the active layers 504 and 505 of the thin-film transistor of the CMOS circuit constituting the buffer circuit 204 is set as large to maximize the ON current characteristics as much as possible.

This is effective for preventing fluctuation from occurring on the integration range dt in expression (2).

Subsequent to the patterning for the formation of the respective active layers, a 5,000-Å-thick aluminum film 507 is formed by sputtering to form a gate electrode. Scandium (or yttrium) is incorporated into the aluminum film 507 at a concentration of from 0.1 to 0.2% by weight to prevent hillocks or whiskers from generating on the aluminum film in the later steps (FIG. 3C).

The hillocks and whiskers are needle-like or prickle-like protrusions attributed to abnormal growth of aluminum on heating.

After the aluminum film 507 is formed, a dense anodic oxide film 508 is formed thereon. The dense anodic oxide film 508 is formed by using an ethylene glycol solution containing 3% of tartaric acid as the electrolytic solution.

More specifically, the anodic oxide film 508 is formed by applying anodic oxidation current in the electrolytic solution by employing a platinum cathode while using the aluminum film 507 as the anode. In the present case, the anodic oxide film 508 is formed to a thickness of about 100 Å. The film thickness is controlled by adjusting the applied voltage.

The anodic oxide film 508 thus obtained functions in such a manner to improve the adhesiveness of the resist mask that is provided on the later steps.

Figure 4A:
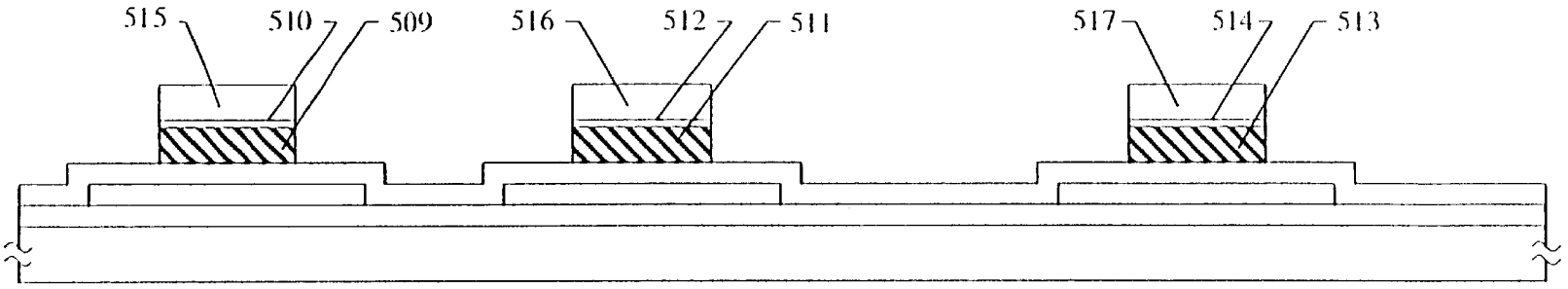
FIGS. 4A to 4C schematically show the process steps for manufacturing the active matrix circuit and the peripheral driver circuit simultaneously.

Thus is obtained a state shown in FIG. 3C. Then, as shown in FIG. 4A, resist masks 515, 516, and 517 are formed, and patterning is performed on the aluminum film 507 (refer to FIG. 3C). In this case, care must be taken in forming the anodic oxide film 508, because patterning becomes difficult to perform on the aluminum film 507 if the anodic oxide film 508 is formed too thick (FIG. 3C).

Referring to FIG. 4A, aluminum patterns 509, 511, and 513 each provide the protocol (base) of the gate electrodes. The anodic oxide films 510, 512, and 514 are the dense anodic oxide films remaining on the aluminum patterns.

Once a state shown in FIG. 4A is obtained, anodic oxidation is performed again. In this case, porous anodic oxide film shown by 518, 519, and 520 are formed (FIG. 4B).

In this step, an aqueous solution containing 3% of oxalic acid is used as the electrolytic solution. Thus, anodic oxidation is performed in this electrolytic solution with utilizing a platinum cathode in combination with aluminum patterns 509, 511, and 513 used as the anodes.

In the present step, anodic oxidation proceeds preferentially on the sides of the aluminum patterns 509, 511, and 513, because resist masks 515, 516, and 517, as well as dense anodic oxide films 510, 512, and 514 are present.

Figure 4B:
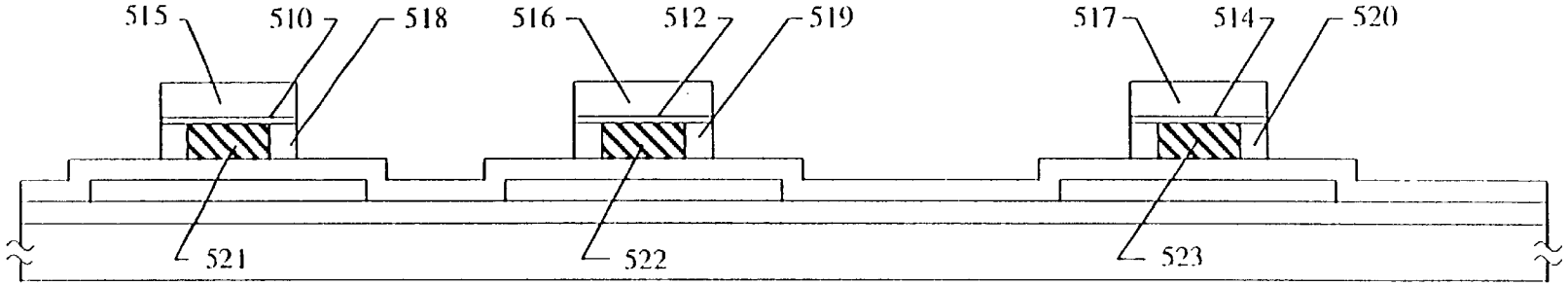

In this manner, porous anodic oxide films are formed on the portions 518, 519, and 520 shown in FIG. 4B. The film thickness (distance of growth) of the porous anodic oxide film can be controlled by adjusting the time period of anodic oxidation.

In the present case, the porous anodic oxide films 518, 519, and 520 are each formed at a thickness of 5,000 Å. The porous anodic oxide films 518, 519, and 520 are used in the later steps for forming the regions of low impurity concentration (LDD (lightly doped drain) regions).

Once the state shown in FIG. 4B is obtained, the resist masks 515, 516, and 517 are removed by using a special stripping solution, and a dense anodic oxide film is formed again. As a result of this step, dense anodic oxide films 51, 52, and 53 are obtained. In this case, anodic oxide films 51, 52, and 53 are formed monolithically with the previously formed anodic oxide films 510, 512, and 514 (FIG. 4C).

Figure 4C:
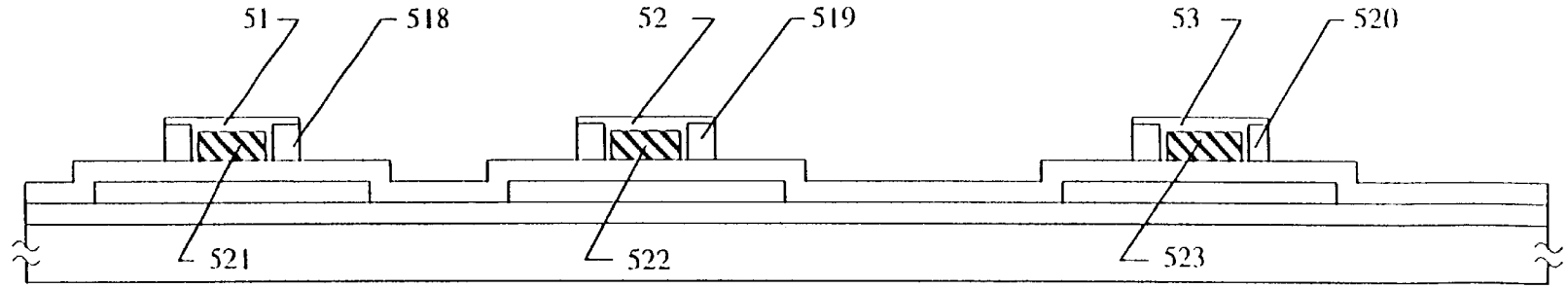

In this step, dense anodic oxide films 51, 52, and 53 shown in FIG. 4C are formed because the electrolytic solution intrudes inside the porous anodic oxide films 518, 519, and 520.

Incidentally, the dense anodic oxide films 51, 52, and 53 are each formed at a film thickness of 1,000 Å. The anodic oxide films 51, 52, and 53 thus formed function as electrical and mechanical protective films for the gate electrodes (inclusive of the gate wirings extending therefrom). More specifically, they improve the electric insulating properties and suppress the generation of hillocks and whiskers.

Referring to FIG. 4C, a gate electrode 521 of the P-channel type thin-film transistor as well as the gate electrodes 522 and 523 of the N-channel type thin-film transistor are established.

Once the state shown in FIG. 4C is obtained, the ion implantation of phosphorus (P) is performed. In this step, the P ions are implanted at a dose amount for forming the source and drain regions. P ions are implanted by using a known plasma doping process (FIG. 5A).

In the present step, P ions are implanted to the respective regions 524, 526, 527, 529, and 530 at a relatively high concentration. In the present step, the ion implantation is performed at a dose of $1\times10^{15}/cm^2$ under an accelerating voltage of 80 kV.

Figure 5A:
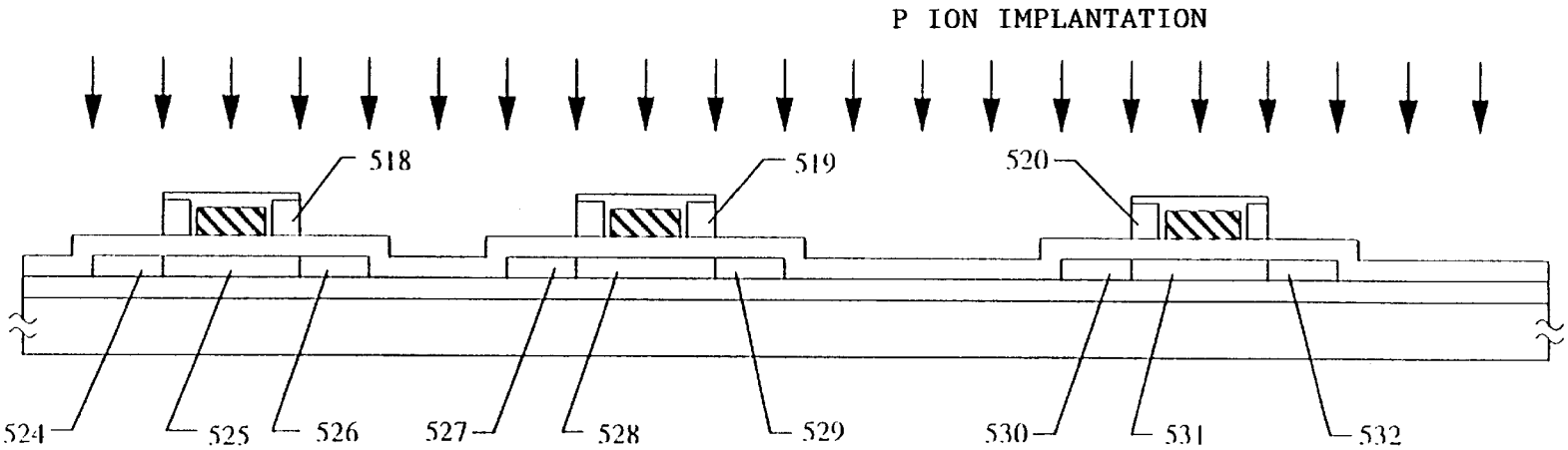
FIGS. 5A and 5B schematically show the process steps for manufacturing the active matrix circuit and the peripheral driver circuit simultaneously.

Referring to FIG. 5A, P ions are not implanted into the regions 525, 528, and 531 in the present step of implantation. Thus, they remain intrinsic or substantially intrinsic.

After the completion of the implantation of P ions as shown in FIG. 5A, a mixed acid comprising phosphoric acid, acetic acid, and nitric acid is used to selectively remove the porous anodic oxide films 518, 519, and 520.

Figure 5B:
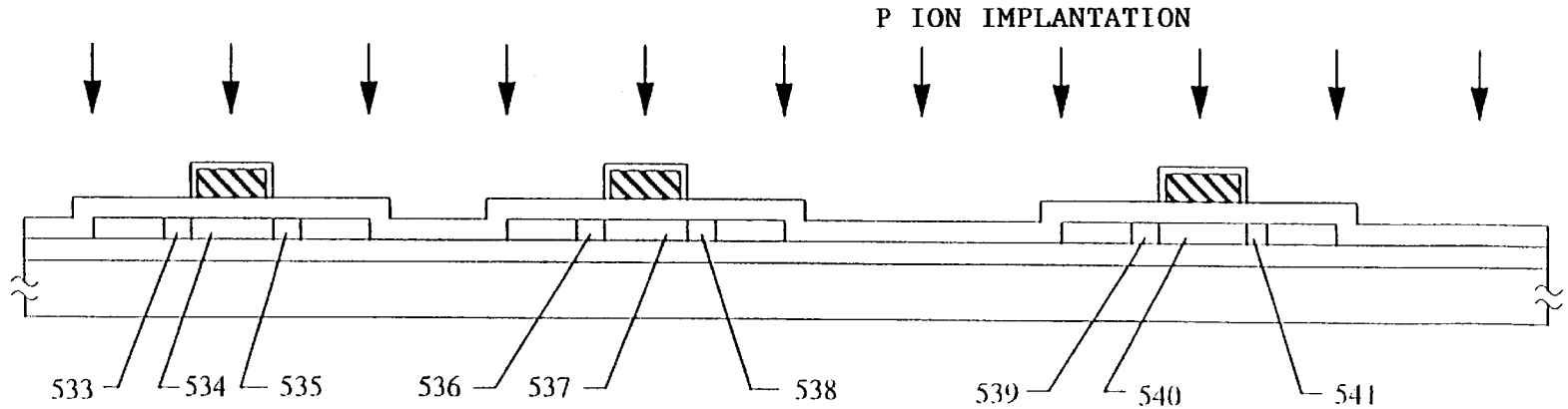

Referring to FIG. 5B, P ions are implanted again at a dose lower than that used in the step with reference to FIG. 5A. Thus, the ion implantation in this step is effected at a dose of from 0.5 to $1\times10^{14}/cm^2$ under an accelerating voltage of 70 kV.

As a result of this step, each of the regions 533, 535, 536, 538, 539, and 541 is converted to exhibit a N-type (weak N type) conductivity. These regions are low concentration impurity regions into which P ions are added at a concentration lower than each of the regions 524, 526, 527, 529, 530, and 532 (FIG. 5B).

The characteristics of the thin-film transistor can be varied by the conditions of forming the low concentration impurity region. More specifically, the value of I in expression (2) can be controlled by the conditions in forming the low concentration impurity region.

Thus are established each of the regions 534, 537, and 540 just under the gate electrode as the channel forming region.

In a strict sense, offset gate regions are formed at the both sides of the channel region with a thickness corresponding to the dense anodic oxide films 51, 52, and 53 formed in the step with reference to FIG. 4C. However, in the present example, the offset gate regions are omitted from the figure because the film thickness of the anodic oxide films 51, 52, and 53 is as small as about 1,000 Å.

Figure 6:
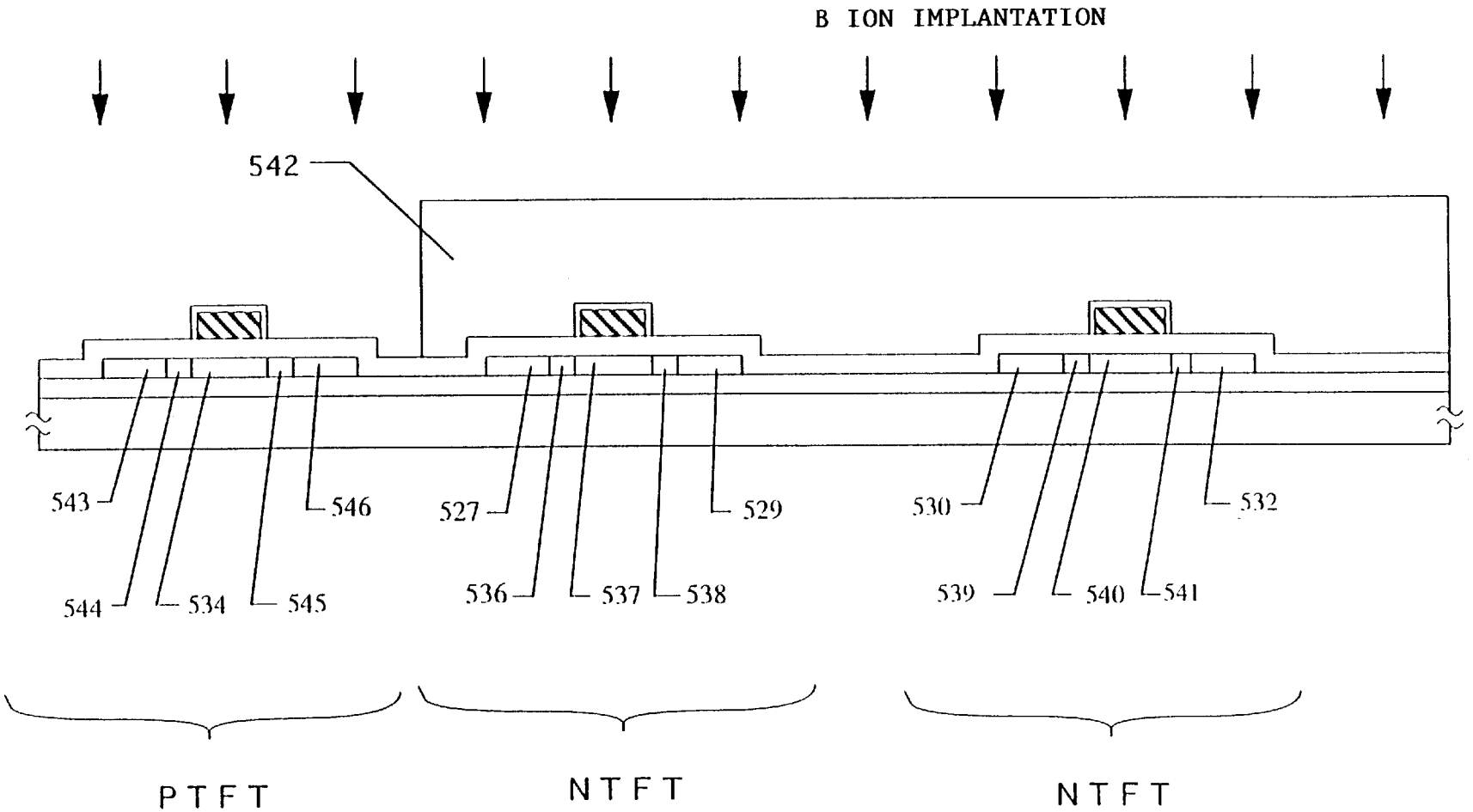
FIG. 6 schematically shows a process step for manufacturing the active matrix circuit and the peripheral driver circuit simultaneously.

Upon completion of the implantation of impurity ions with reference to FIG. 5B, a resist mask 542 is placed as shown in FIG. 6 to implant boron (B) ions.

By performing the ion implantation of B ions, each of the regions 543, 544, 545, and 546 is converted from a N-type conductivity to P-type conductivity. The B-ion implantation in this step is performed at a dose of $2\times10^{15}/cm^2$ under an accelerating voltage of 60 kV.

After completing the implantation of B ions with reference to FIG. 6, the resist mask 542 is removed, and a KrF excimer laser is irradiated to the entire structure to anneal the region implanted with impurity ions and to activate the thus implanted impurity ions.

Thus are formed simultaneously a P-channel type thin-film transistor (PTFT) and a N-channel type thin-film transistor (NTFT) constituting a CMOS circuit, as well as a N-channel type thin-film transistor (NTFT) provided in the active matrix region.

Figures 7A, 7B:
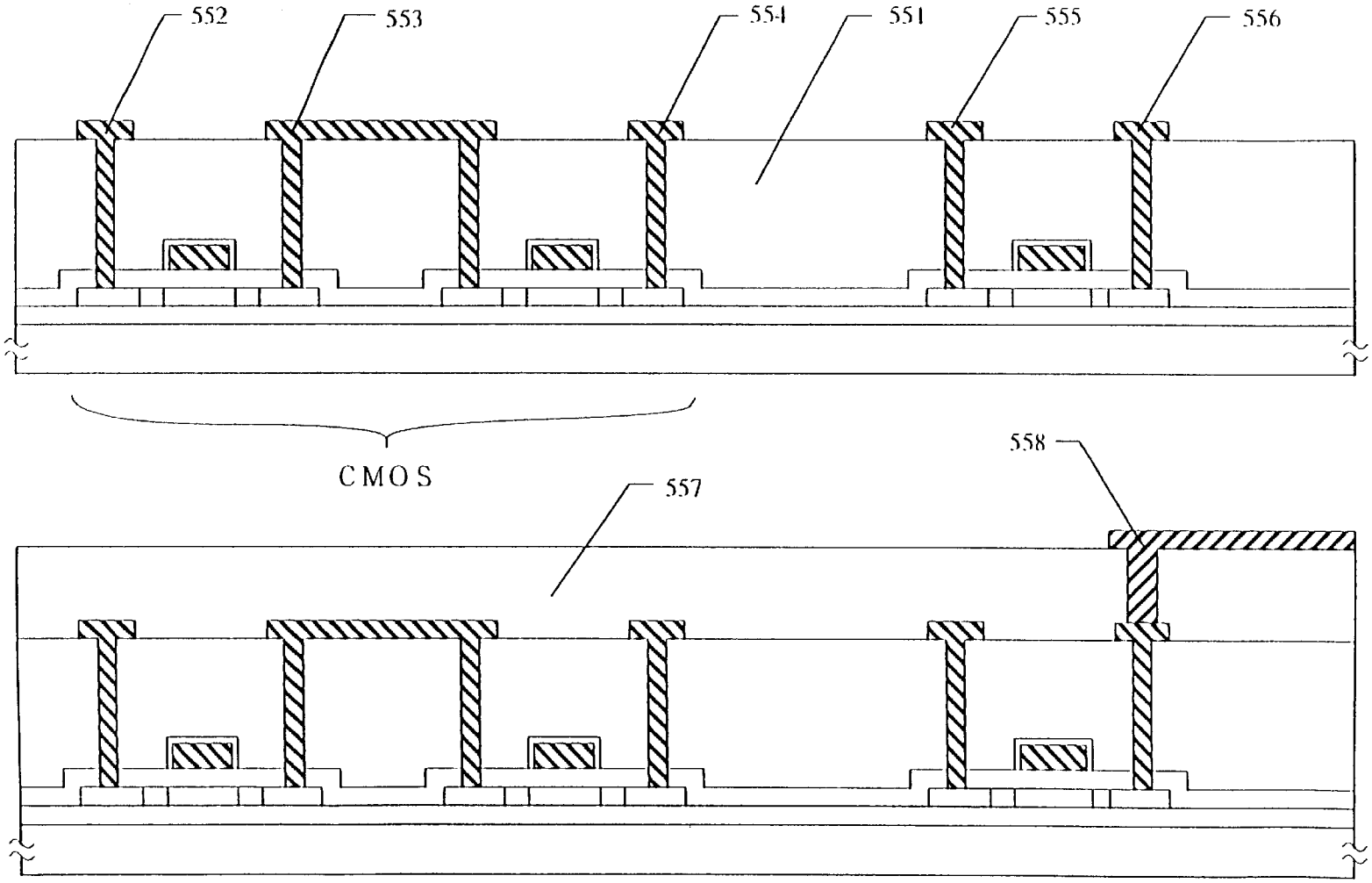
FIGS. 7A and 7B schematically show the process steps for manufacturing the active matrix circuit and the peripheral driver circuit simultaneously.

Then, referring to FIG. 7A, an interlayer insulating film 551 is formed by using a silicon oxide film. Otherwise, a layered film of silicon nitride film and silicon oxide film, or a layered film of silicon oxide film or silicon nitride film with a resin film can be used in the place of the silicon oxide film.

Once the interlayer insulating film 551 is obtained, contact holes are formed thereon. Then, a source electrode 552 and a drain electrode 553 for the P-channel type thin-film transistor as well as a drain electrode 553 and a source electrode 554 for the N-channel type thin-film transistor are formed.

Thus is implemented a CMOS circuit comprising a P-channel type thin-film transistor and a N-channel type thin-film transistor provided in a complementary constitution.

At the same time, a source electrode 555 (in general, it is provided by extending the image signal lines, i.e., the source signal lines, provided in a matrix form) and a drain electrode 556 are formed to implement a N-channel type thin-film transistor to be provided in the active matrix circuit.

After obtaining the state shown in FIG. 7A, a second interlayer insulating film 557 is formed, and a pixel electrode 558 made of ITO is formed after forming a contact hole.

Then, heat treatment is performed for 1 hour at 350° C. under hydrogen atmosphere to compensate for the defects in the active layer. In this manner, an active matrix circuit (pixel matrix circuit) is formed simultaneously with the peripheral driver circuit.

After the structure shown in FIG. 7B is obtained, a rubbing film (not shown) is formed, and a known rubbing treatment is applied.

The resulting substrate shown in FIG. 7B is adhered with a separately prepared opposing substrate by taking a predetermined gap therebetween, and a liquid crystal is injected therein. Thus is obtained an active matrix liquid crystal display device having an integrated peripheral driver circuit.

EXAMPLE 2

Figure 8:
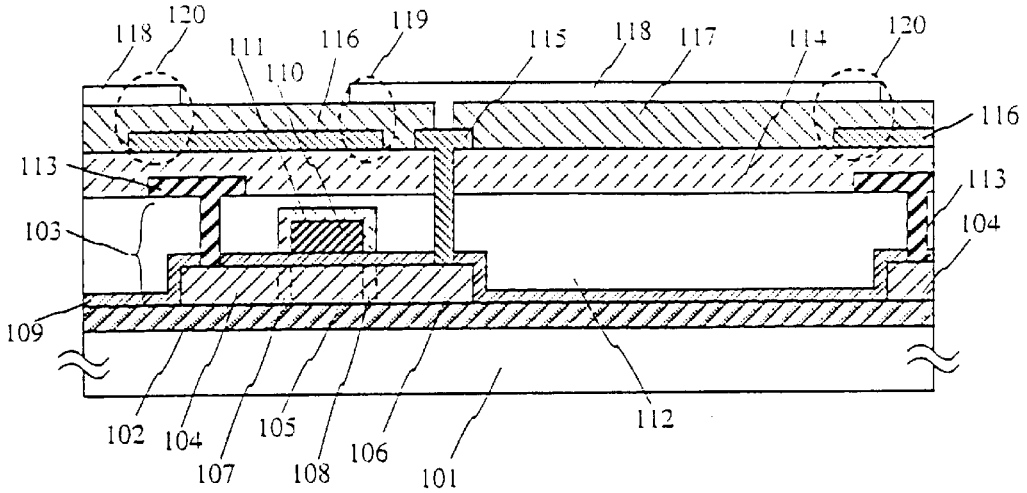
FIG. 8 is a cross section view of a single pixel portion of the active matrix circuit.

The present example refers to a constitution in which the value of Ct in expression (2) is maximized. In the present example, the active matrix region is taken in such a constitution shown in FIGS. 8 and 9. FIG. 8 shows the cross sectional view taken along line A–A' shown in FIG. 9.

Figure 9:
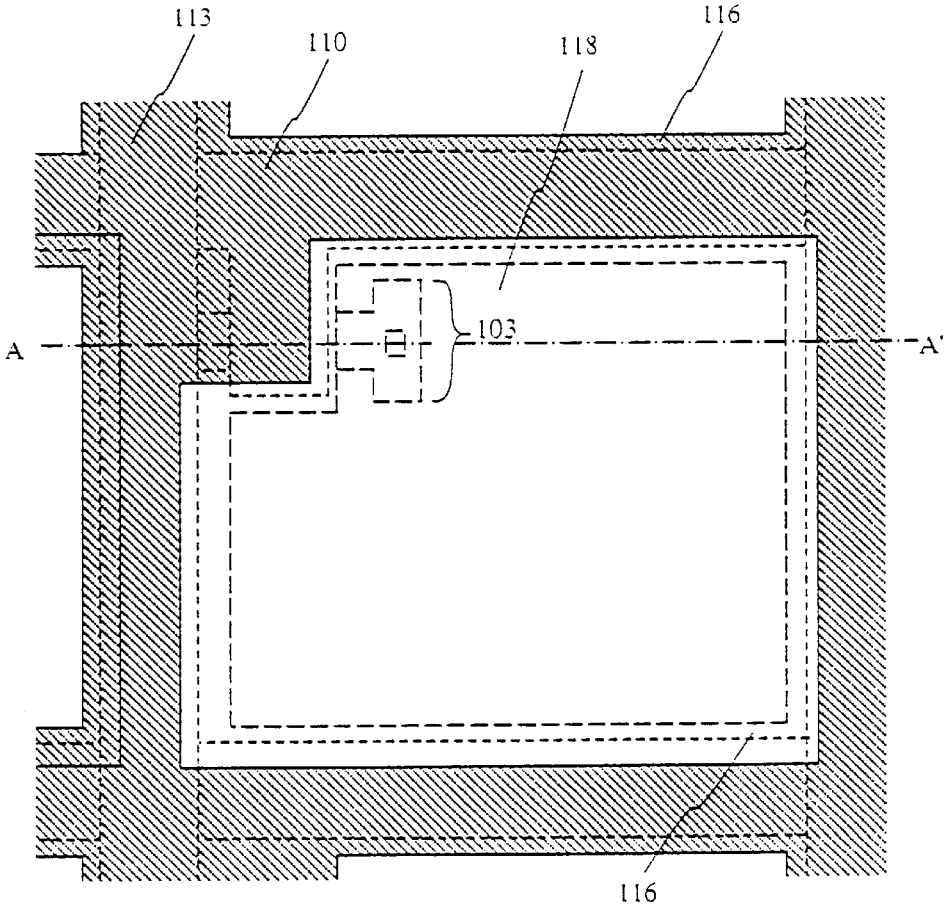
FIG. 9 is a top view of a single pixel portion of the active matrix circuit.

Referring to FIGS. 8 and 9, the constitution shows a part of the substrate on which the active matrix circuit is provided. In FIGS. 8 and 9 are shown a portion corresponding to a single pixel.

Referring to FIGS. 8 and 9, a thin-film transistor is formed on a portion defined by reference numeral 103. Reference numeral 101 denotes a glass substrate 101. Also, reference numeral 102 denotes a silicon oxide film constituting an underlying film. The active layer of the thin-film transistor consists of portions 104, 107, 105, 108, and 106. The active layer is made of a crystalline silicon film obtained by crystallizing an amorphous silicon film by applying heating.

In this active layer, reference numeral 104 denotes a source region; 107 and 108, offset regions; 105, a channel forming region; and

106, a drain region.

Reference numeral 109 denotes a silicon oxide film that functions as a gate insulating film. Reference numeral 110 denotes a gate electrode containing aluminum as a main component. The gate electrodes are extended from the gate wirings arranged in matrix form.

An anodic oxide film 111 is formed by anodic oxidation using aluminum as the anode. The offset gate regions 107 and 108 are formed at a thickness corresponding to the thickness of the anodic oxide film.

It is necessary to form the anodic oxide film 111 at a thickness of about 2,000 Å or thicker to form an offset gate region which functions effectively.

Reference numeral 112 denotes a first interlayer insulating film comprising a silicon oxide film. Reference numeral 113 denotes a lead electrode 113 from the source region 104. Also, reference numeral 115 denotes lead electrode from the drain region 106 consisting of titanium. The electrode is connected to an ITO electrode 118 that forms a pixel electrode. Further, reference numeral 114 denotes a second interlayer insulating film, and reference numeral 117 denotes a third interlayer insulating film.

Reference numeral 116 denotes a titanium electrode that also functions as a black matrix (BM). Chromium and the like may be used in place of titanium. The titanium electrode 116 is provided superposed on the peripheral portion of the pixel electrode 118 in such a manner that it may function as a BM. The titanium electrode 116 is formed simultaneously with the lead electrode 115.

The region of the titanium electrode 116, which functions also as BM, being superposed on the pixel electrode 118 provides an auxiliary capacitance. More specifically, the pixel electrode and the 10 titanium electrode 116 with an insulating film 117 interposed therebetween form a capacitance at the portions 119 and 120. The capacitance may have a large capacity because the insulating film 117 can be thinned.

In the present case, the insulating film 117 is provided by a 300-Å-thick silicon nitride film formed by plasma CVD.

A silicon nitride film yields a high dielectric constant of about 6. Thus, the capacity Ct in expression (2) can be increased. The dielectric constant of a silicon oxide film generally used as an insulating film is approximately 4.

Furthermore, the silicon nitride film may be provided as a dense film. Thus, even in case the silicon nitride film is provided thin, the problem of forming short circuit between the electrodes attributed to the generation of pin holes can be circumvented. The titanium electrode 116 is arranged in such a manner that it may cover the thin-film transistor 103. In this manner, even when light is irradiated to the thin-film transistor 103, the influence of light irradiation can be avoided.

The degree of overlapping the electrode 116 constituting the BM and the pixel electrode 118 is determined in such a manner that it may satisfy the value of Ct derived from the relation expressed by expression (2).

EXAMPLE 3

The present example refers to a case in which, in order to satisfy the relation expressed by expression (2), the fall of the signal waveform supplied from the gate driver circuit is intentionally delayed as is shown in FIG. 12.

As is described in the foregoing, the relation expressed by expression (2) can be effectively satisfied by increasing the total pixel capacity Ct. However, this can be achieved by increasing the capacity of the auxiliary capacitance, and this is limited by, for example, the problem of the area allowed for the auxiliary capacitance.

In the present example, the structure is not modified, but the shape of the gate signal waveform is changed to satisfy the relation of expression (2). As a matter of fact, it is also possible to modify the structure in such a manner to satisfy the relation of expression (2) and further adopting the constitution of the present example.

Figure 10:
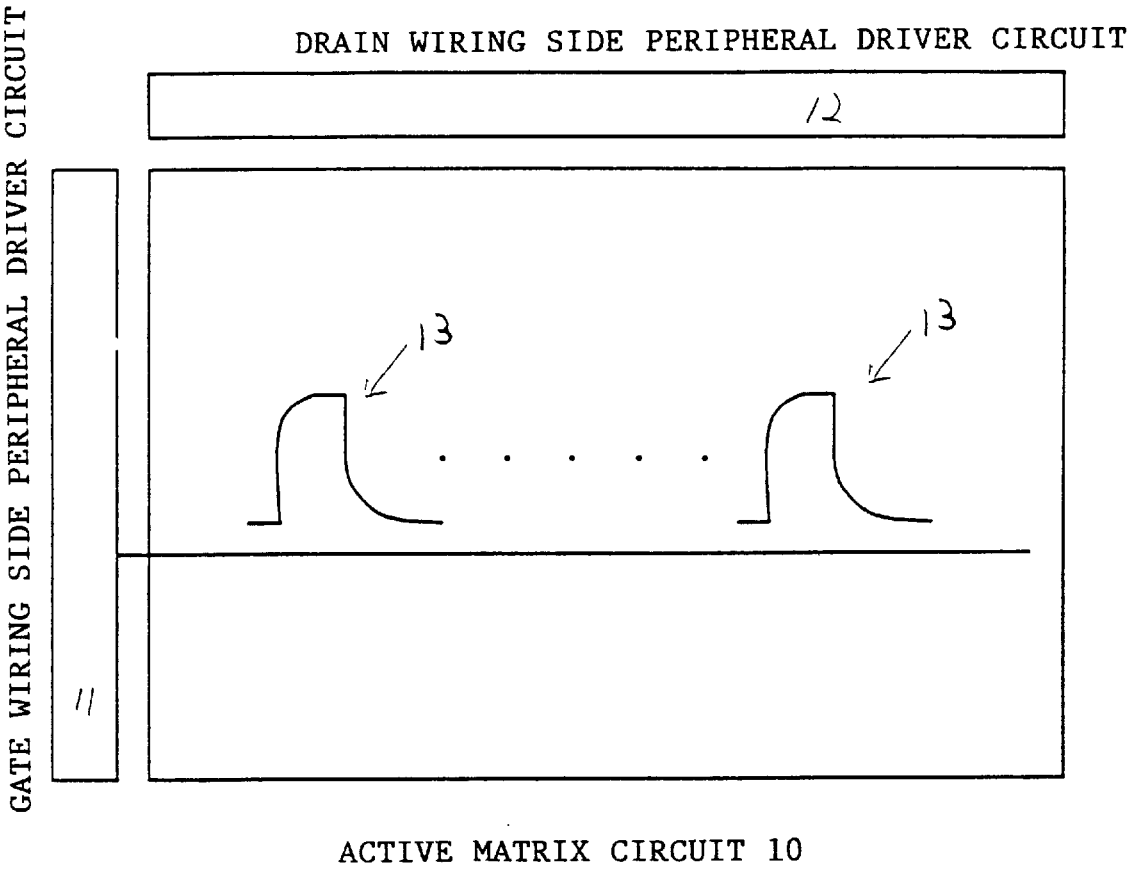
Fig. 10 Prior Art
FIG. 10 shows a drive waveform in the active matrix circuit.
Figure 11:
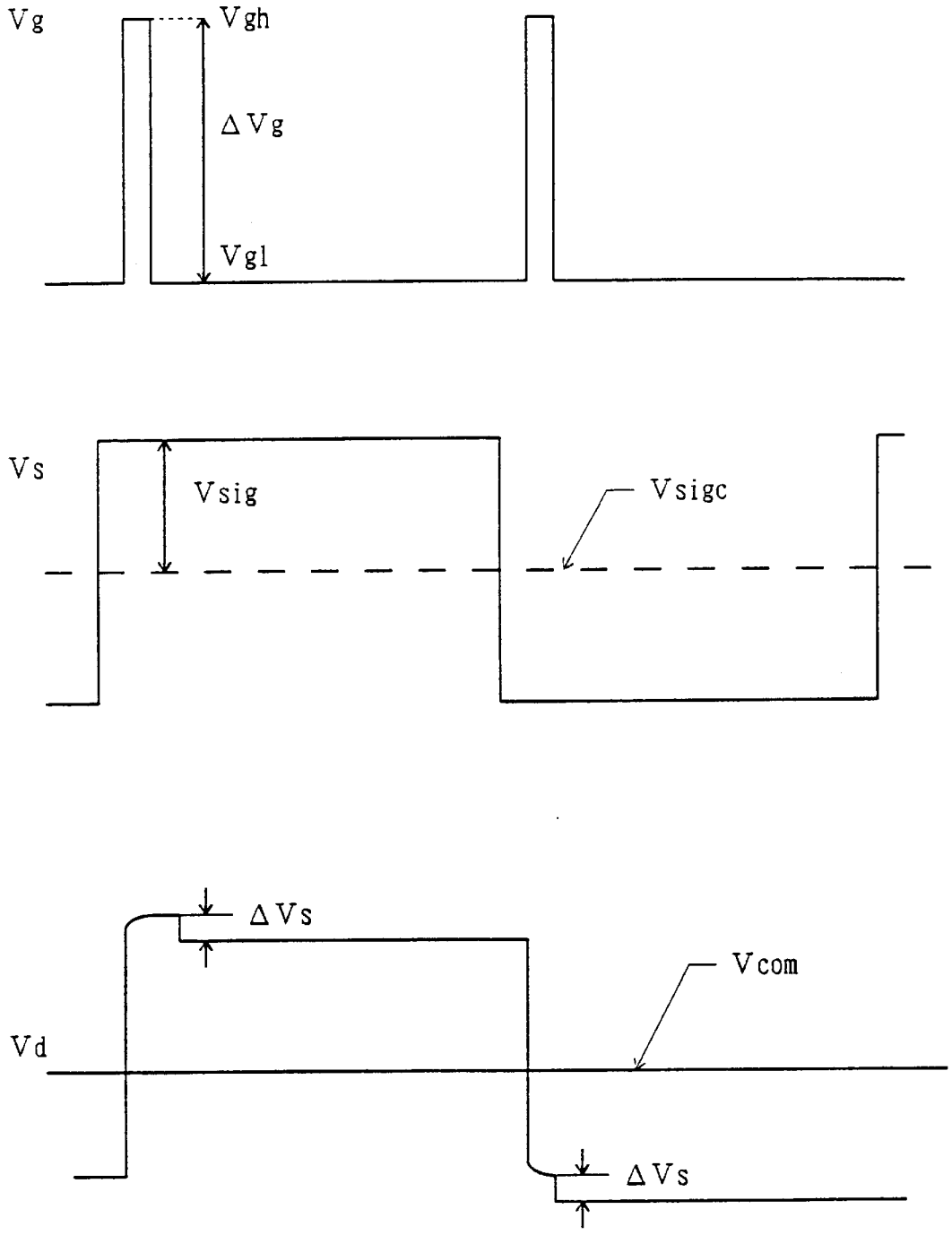
FIG. 11 shows a signal voltage waveform for driving a thin-film transistor of the active matrix circuit.

In case the buffer circuit of the peripheral driver circuit is constructed by a thin-film transistor, the distortion of the waveform inevitably generates as is shown in FIG. 10.

The constitution according to the present example utilizes the fact that the delay in the fall of the gate signal waveform contributes to the change of $\int Idt$. In other words, the delay in the fall of the gate signal waveform is controlled to change the value of $\int Idt$ in such a manner to satisfy the relation of expression (2).

The delay in the fall of the gate signal waveform can be controlled by, for example, employing a waveform in which the signal voltage is decreased stepwise as shown in FIG. 12.

In this manner, the value of the feed through voltage $\Delta Vs$ expressed by expression (1) can be minimized so as to reduce the influence of the fluctuation thereof. More specifically, by reducing the value of the feed through voltage $\Delta Vs$ to such a value lower than the voltage Vgr necessary for realizing a single gradation display, the influence of the fluctuation in the feed through voltage $\Delta Vs$ can be suppressed. Thus is realized an image of high quality.

As described in the foregoing, the present invention enables the determination of which parameter to be treated with priority in applying technological consideration. Thus, an active matrix display device having higher image quality can be implemented.

An active matrix display device having high image quality can be also realized by controlling the delay in the fall of gate signal waveform.

In the description above, reference is principally made to an active matrix liquid crystal display device. However, the present invention is applicable to other types of flat panel display devices of an active matrix type employing thin-film transistors. For instance, it can be applied to an active matrix display device of a peripheral driver circuit-integrated type using EL light emitting elements.

Furthermore, it is also possible to employ a thin-film transistor having a bottom gate type structure in which the gate electrode is placed on the substrate side.

While the invention has been described in detail, it should be understood that the present invention is not to be construed as being limited thereto, and that any modifications can be made without departing from the scope of claims.

What is claimed is:

1. An active matrix display device with a plurality of gradational levels, said device comprising:

a plurality of pixels being arranged in a matrix form, each of the plurality of pixels having a pixel electrode and a thin film transistor being connected to the pixel electrode, said thin film transistor including:

a source region, a drain region, and a channel region being interposed between the source and drain region, a gate electrode being formed adjacent to at least the channel region with a gate insulating film interposed therebetween, wherein a current flows between the source region and the drain region while the thin film transistor turns off, wherein a signal voltage supplied to the gate electrode is delayed in fall of a signal waveform, so that the current flows to correct a feed through voltage $\Delta Vs$, whereby, the feed through voltage $\Delta Vs$ is set lower than a voltage Vgr necessary for realizing a single gradation.

2. A device according to claim 1, wherein each of the source region, the drain region, and the channel region of the thin film transistor is formed in a crystalline semiconductor island.

3. A device according to claim 1, wherein the active matrix display device further comprises at least a driving circuit for driving the thin film transistor, wherein the thin film transistor and the driving circuit are formed over one substrate.

4. A device according to claim 3, wherein the driving circuit includes at least one selected from the group consisting of a shift register circuit, a NAND circuit, a level shift circuit, and a buffer circuit.

5. A device according to claim 1, wherein the active matrix display device includes a plurality of EL light emitting elements.

6. A method of driving an active matrix device with a plurality of gradational levels, said active matrix device comprising:

a plurality of pixels in a matrix form, each of the plurality of pixels including a pixel electrode and a thin film transistor connected to the pixel electrode, said thin film transistor including:

a source region, a drain region, and a channel region being interposed between the source and drain region, a gate electrode being formed adjacent to at least the channel region with a gate insulating film interposed therebetween, said method comprising:

supplying a gate voltage to the gate electrode; and supplying a source voltage to the source region according to supplying the gate voltage, thereby, applying a voltage to the pixel electrode, said source voltage being selected in accordance with a desired gradational level of each of the pixels, wherein a current flows between the source region and the drain region while the thin film transistor turns off, wherein the gate voltage supplied to the gate electrode is delayed in fall of a signal waveform, so that the current flows to correct a feed through voltage $\Delta Vs$, whereby, the feed through voltage $\Delta Vs$ is set smaller than a voltage Vgr necessary for realizing a single gradational level.

7. A method according to claim 6, wherein each of the source region, the drain region, and the channel region of the thin film transistor is formed in a crystalline semiconductor island.

8. A method according to claim 6, wherein the active matrix device further comprises at least a driving circuit for driving the thin film transistor, wherein the thin film transistor and the driving circuit are formed over one substrate.

9. A method according to claim 8, wherein the driving circuit includes at least one selected from the group consisting of a shift register circuit, a NAND circuit, a level shift circuit, and a buffer circuit.

10. A method according to claim 6, wherein the active matrix device includes a plurality of EL light emitting elements.

11. An active matrix display device with a plurality of gradational levels, said device comprising:

a plurality of pixels being arranged in a matrix form, each of the plurality of pixels having a pixel electrode and an n-channel thin film transistor being connected to the pixel electrode, said n-channel thin film transistor including:

a source region, a drain region, and a channel region being interposed between the source and drain region, each of the source and drain regions including an n-type impurity at a first concentration, a first low concentration impurity region being formed between the source and channel regions and a second low concentration impurity region being formed between the channel and drain region, each of the first and second low concentration impurity regions including the n-type impurity at a second concentration lower than the first concentration, a gate electrode being formed adjacent to at least the channel region with a gate insulating film interposed therebetween, wherein a current flows between the source region and the drain region while the thin film transistor turns off, wherein a signal voltage supplied to the gate electrode is delayed in fall of a signal waveform, so that the current flows to correct a feed through voltage ΔVs, whereby, the feed through voltage ΔVs is set lower than a voltage Vgr necessary for realizing a single gradation.

12. A device according to claim 11, wherein each of the source region, the drain region, and the channel region of the thin film transistor is formed in a crystalline semiconductor island.

13. A device according to claim 11, wherein the active matrix display device further comprises at least a driving circuit for driving the thin film transistor, wherein the thin film transistor and the driving circuit are formed over one substrate.

14. A device according to claim 13, wherein the driving circuit includes at least one selected from the group consisting of a shift register circuit, a NAND circuit, a level shift circuit, and a buffer circuit.

15. A device according to claim 11, wherein the active matrix display device includes a plurality of EL light emitting elements.

16. An active matrix display device comprising:

a pixel portion over a first substrate;

a peripheral driving circuit portion over the first substrate;

said pixel portion including:

a first plurality of lines and a second plurality of lines being located in a matrix form;

a plurality of pixels, each of the pixels being located at an intersection of each of the first and second pluralities of lines;

at least a thin film transistor being located in each of the pixels, said thin film transistor comprising a source region, a drain region, and a channel region formed between the source and drain regions;

a gate electrode being adjacent to at least the channel region with a gate insulating film therebetween;

a pixel electrode being formed in each of the pixel;

wherein the gate electrode is electrically connected to each of the first plurality of lines, the source region is electrically connected to each of the second plurality of lines, and the drain region is electrically connected to the pixel electrode, wherein Vg is defined by a first signal voltage supplied from each of the first plurality of lines to the gate electrode, Vs is defined by a second signal voltage supplied from each of the second plurality of lines to the source region, and Vd is defined by a waveform of a voltage applied from the pixel electrode, wherein a feed through voltage ΔVs is defined by a fluctuation of Vs when the thin film transistor is switched, wherein a current flows between the source region and the drain region while the thin film transistor turns off, wherein the first signal voltage supplied to the gate electrode is delayed in fall of a signal waveform, so that the current flows to correct the feed through voltage ΔVs, whereby, ΔVs is lower than Vgr necessary for realizing a single gradation.

17. A device according to claim 16, wherein each of the source region, the drain region, and the channel region of the thin film transistor is formed in a crystalline semiconductor island.

18. A device according to claim 16, wherein the peripheral driving circuit portion includes at least one selected from the group consisting of a shift register circuit, a NAND circuit, a level shift circuit, and a buffer circuit.

19. A device according to claim 16, wherein the active matrix display device includes a plurality of EL light emitting elements.

20. An active matrix display device comprising:

a plurality of pixels being arranged in a matrix form, each of the plurality of having a pixel electrode and a thin film transistor being connected to the pixel electrode, said thin film transistor including:

a source region, a drain region, and a channel region being interposed between the source and drain region, a gate electrode being formed adjacent to the channel region with a gate insulating film interposed therebetween, wherein a current flows between the source region and the drain region while the thin film transistor turns off, wherein a signal voltage supplied to the gate electrode is delayed in fall of a signal waveform, so that the current flows to correct a feed through voltage ΔVs, whereby, the feed through voltage ΔVs is set lower than a voltage Vgr necessary for realizing a single gradation, wherein the signal voltage is decreased stepwise to control the delay in fall of the signal waveform.

21. A device according to claim 20, wherein each of the source region, the drain region, and the channel region of the thin film transistor is formed in a crystalline semiconductor island.

22. A device according to claim 20, wherein the active matrix display device further comprises at least a driving circuit for driving the thin film transistor, wherein the thin film transistor and the driving circuit are formed over one substrate.

23. A device according to claim 22, wherein the driving circuit includes at least one selected from the group consisting of a shift register circuit, a NAND circuit, a level shift circuit, and a buffer circuit.

24. A device according to claim 20, wherein the active matrix display device includes a plurality of EL light emitting elements.

25. A method of driving an active matrix device with a plurality of gradational levels, said active matrix device comprising:

a plurality of pixels in a matrix form, each of the plurality of pixels including a pixel electrode and a thin film transistor connected to the pixel electrode, said thin film transistor including:

a source region, a drain region, and a channel region being interposed between the source and drain region, a gate electrode being formed adjacent to at least the channel region with a gate insulating film interposed therebetween, said method comprising:

supplying a gate voltage to the gate electrode; and supplying a source voltage to the source region according to supplying the gate voltage, thereby, applying a voltage to the pixel electrode, said source voltage being selected in accordance with a desired gradational level of each of the pixels, wherein a current flows between the source region and the drain region while the thin film transistor turns off, wherein the gate voltage supplied to the gate electrode is delayed in fall of a signal waveform, so that the current flows to correct a feed through voltage $\Delta Vs$, whereby, the feed through voltage $\Delta Vs$ is set smaller than a voltage Vgr necessary for realizing a single gradational level, wherein the gate voltage is decreased stepwise to control the delay in fall of the signal waveform.

26. A method according to claim 25, wherein each of the source region, the drain region, and the channel region of the thin film transistor is formed in a crystalline semiconductor island.

27. A method according to claim 25, wherein the active matrix device further comprises at least a driving circuit for driving the thin film transistor, wherein the thin film transistor and the driving circuit are formed over one substrate.

28. A method according to claim 27, wherein the driving circuit includes at least one selected from the group consisting of a shift register circuit, a NAND circuit, a level shift circuit, and a buffer circuit.

29. A method according to claim 25, wherein the active matrix device includes a plurality of EL light emitting elements.

* * * * *

UNITED STATES PATENT AND TRADEMARK OFFICE

CERTIFICATE OF CORRECTION

PATENT NO. : 6,229,531 B1 
DATED : May 8, 2001
INVENTOR(S) : Setsuo Nakajima, Katunobu Awane and Tatsuo Morita It is certified that error appears in the above-identified patent and that said Letters Patent is hereby corrected as shown below:

Title page,
Item [73], please add:

-- Sharp Kabushiki Kaisha
22-22, Nagaike-Cho, Abeno-Ku, Osaka-Shi
Osaka 545-0013, Japan. --

Signed and Sealed this

Ninth Day of July, 2002

*Attest:*

*Attesting Officer*

JAMES E. ROGAN
*Director of the United States Patent and Trademark Office*